US006817040B2

(12) United States Patent
Klinkhammer et al.

(10) Patent No.: US 6,817,040 B2
(45) Date of Patent: Nov. 16, 2004

(54) TOILET RIM MOUNTED LIQUID DISPENSER USING VERTICAL WICKING SYSTEM

(75) Inventors: Michael E. Klinkhammer, Racine, WI (US); Simon M. Conway, Burlington, WI (US); Richard P. Harbutt, Berks (GB); David C. Snow, Gloucestershire (GB); Peter T.M. Nott, Wiltshire (GB)

(73) Assignee: S. C. Johnson & Son, Inc., Racine, WI (US)

( * ) Notice: Subject to any disclaimer, the term of this patent is extended or adjusted under 35 U.S.C. 154(b) by 60 days.

(21) Appl. No.: 10/435,359

(22) Filed: May 9, 2003

(65) Prior Publication Data

US 2004/0016044 A1 Jan. 29, 2004

Related U.S. Application Data

(60) Provisional application No. 60/379,586, filed on May 10, 2002.

(51) Int. Cl.[7] ..... E03D 9/02
(52) U.S. Cl. ..... 4/231
(58) Field of Search ..... 4/231

(56) References Cited

U.S. PATENT DOCUMENTS

| | | | | |
|---|---|---|---|---|
| 597,811 | A | 1/1898 | Calkins | |
| 681,100 | A | 8/1901 | Calkins | |
| 954,426 | A | 4/1910 | Dreifuss | |
| 975,925 | A | 11/1910 | Bach | |
| 981,636 | A | 1/1911 | Goldman | |
| RE13,551 | E | 4/1913 | Williams | |
| 1,117,868 | A | 11/1914 | Lewers | |
| 1,349,703 | A | 8/1920 | Williams | |
| 1,691,359 | A | * 11/1928 | Pulkinghorn | 4/226.1 |
| 1,880,912 | A | 10/1932 | Duwelius | |
| 1,974,955 | A | 9/1934 | Foltis | |
| 1,979,755 | A | 11/1934 | McDermott | |
| 2,214,798 | A | 9/1940 | Reikosky | |
| 3,529,309 | A | 9/1970 | Leavitt et al. | |
| 3,588,926 | A | 6/1971 | Buck, Jr. | |
| 3,736,600 | A | 6/1973 | Drinkwater | |
| 3,946,448 | A | 3/1976 | Sioufy | |
| 4,913,350 | A | 4/1990 | Purzycki | 239/44 |
| 5,647,053 | A | 7/1997 | Schroeder et al. | |
| 6,178,564 | B1 | 1/2001 | Leonard et al. | |
| 6,230,334 | B1 | 5/2001 | Camp et al. | |
| 6,361,752 | B1 | 3/2002 | Demarest et al. | |
| 6,662,380 | B1 | * 12/2003 | Leonard et al. | 4/231 |
| 2002/0116751 | A1 | 8/2002 | Slade | |
| 2002/0148036 | A1 | 10/2002 | Wilson et al. | |

FOREIGN PATENT DOCUMENTS

| | | | |
|---|---|---|---|
| DE | 3419169 A1 | 11/1985 | E03D/9/03 |
| EP | 538957 A1 | 4/1993 | |
| EP | 785315 A1 | 7/1997 | |
| GB | 296338 | 8/1928 | |
| WO | WO 99/66139 A1 | 12/1999 | |
| WO | WO 99/66140 A1 | 12/1999 | |
| WO | WO 01/32995 A1 | 5/2001 | |
| WO | WO 01/44589 A1 | 6/2001 | |
| WO | WO01/44591 A1 | 6/2001 | E03D/9/03 |
| WO | WO 01/88286 A1 | 11/2001 | |

* cited by examiner

*Primary Examiner*—Charles E. Phillips

(57) ABSTRACT

A device for dispensing liquids from under the rim of a toilet bowl is disclosed. The dispensing device includes a reservoir for holding a liquid, a wick, and means for suspending the reservoir from the toilet bowl rim. The wick transports the liquid upward from the reservoir to a position at or above an upper surface of the reservoir. During a toilet flush, flush water washes liquid on the upper surface of the reservoir and/or liquid on the wick into the toilet bowl. The wick is formed from a hydrophobic material in order to repel flush water so that flush water does not travel down the side of the wick and dilute the liquid in the reservoir with flush water. In another aspect, the suspension means and/or the entire device is not visible from above the rim of the toilet bowl when the dispensing device is installed on the rim.

40 Claims, 6 Drawing Sheets

TOILET RIM MOUNTED LIQUID DISPENSER USING VERTICAL WICKING SYSTEM

CROSS-REFERENCES TO RELATED APPLICATIONS

This application claims priority from U.S. Provisional Patent Application No. 60/379,586, filed May 10, 2002.

STATEMENT REGARDING FEDERALLY SPONSORED RESEARCH

Not Applicable.

BACKGROUND OF THE INVENTION

1. Field of the Invention

This invention relates to liquid dispensers, and in particular to devices for dispensing cleaning and freshening liquids from under the rim of a toilet bowl.

2. Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various automatic continuous cleaning toilet bowl cleaning products have been proposed. One type of product comprises a solid block or solid particles of a cleansing and freshening substance that is suspended from the rim of a toilet bowl in a container that is placed in the path of the flushing water. U.S. Pat. Nos. 3,529,309 and 2,214,798 show examples of this type of toilet bowl cleaning system. Typically, a portion of the solid block is dissolved in the flush water with each flush, and the flush water having dissolved product is dispensed into the toilet bowl for cleaning the bowl. These solid block toilet cleaning systems have certain disadvantages such as a short lifetime and a decline in the amount of cleaning and deodorizing agents released into the toilet bowl as the solid block deteriorates.

Other automatic, continuous cleaning, toilet bowl cleaning systems use a liquid cleaning agent that is dispensed into a toilet bowl. For example, European Patent Application Nos. EP-0538957 and EP-0785315, U.S. Pat. Nos. 3,946,448, 6,178,564 B1 and 6,230,334 B1, and PCT International Publication Nos. WO 99/66139 and WO 99/66140 all disclose cleansing and/or freshening devices capable of being suspended from the rim of a toilet bowl for the purpose of introducing liquid active substances from a bottle into the flushing water with each flush. Typically, the liquid active substances may include one of more of the following: surfactants (such as a mixture of an anionic surfactant and a nonionic surfactant), solvents, sequesterants, pH controllers, thickeners, preservatives, fragrances, and dyes. In these under the toilet rim devices, the liquid active substances are delivered downward from a reservoir to a wicking device (e.g., a dispensing plate or porous mass) that is supported by a base that is suspended from the toilet rim. The device is suspended from the toilet rim such that the flow of flush water from the toilet contacts the wicking device during a flush. The flush water carries the liquid active substances that are on the wicking device into the toilet bowl to clean and freshen the toilet.

One disadvantage with these known under the toilet rim liquid dispensing devices is that the devices use a gravity fed wicking system to deliver the liquid active substances into the flush water, and as a result, in some of these devices, water may enter the reservoir thereby diluting the liquid active substances. Thus, there is a need for an improved under the toilet rim liquid dispensing device wherein flush water is prevented from entering the reservoir and thereby diluting the liquid active substances in the reservoir.

Another disadvantage with these known under the toilet rim liquid dispensing devices is that the devices can be quite bulky and as a result, these devices spoil the look of the toilet. What is needed therefore is an improved toilet rim mounted device for dispensing a liquid wherein the device is more completely hidden from view when the device is installed on a toilet rim.

BRIEF SUMMARY OF THE INVENTION

The foregoing needs are met by a dispensing device according to the invention in which a flow of water during a toilet flush is used to dispense liquids into a toilet bowl. The dispensing device includes a reservoir for holding a liquid, a wick, and a suspension means. The reservoir has an upper surface with an opening, and the wick is disposed in the opening such that the wick contacts the liquid in the reservoir and extends to a position at or above the upper surface of the reservoir. The wick transports the liquid upward from the reservoir to the position at or above the upper surface of the reservoir. The suspension means is for suspending the reservoir from a rim of the toilet bowl, and the dispensing device is positioned within the flow of water during a toilet flush such that at least a portion of the flow of water is directed onto the wick and the upper surface of the reservoir whereby liquid on the upper surface of the reservoir and/or liquid on the wick is delivered into the toilet bowl during the toilet flush.

The liquid is formulated with surfactants and the wick is formed from a hydrophobic material such that the liquid is transported upward on the wick from the reservoir to the position at or above the upper surface of the reservoir. During a toilet flush, the flow of water washes liquid on the upper surface of the reservoir and/or liquid on the wick into the toilet bowl. The use of hydrophobic material in the wick serves to repel flush water from the wick and thereby prevents flush water from traveling down the wick and entering the reservoir during a flush. As a result, the remaining liquid in the reservoir is not diluted by the flush water. Various configurations of the wick provide for upward liquid transport on the wick. For example, the wick may include fluid transport channels such as vertical grooves in an outer surface of the wick or interconnected pores in the wick structure. Preferably, the wick comprises sintered polyethylene.

In a second aspect, the invention provides an improved toilet rim mounted device for dispensing a liquid wherein the device is hidden from view when the device is installed on a toilet rim. The dispensing device uses the flow of water during a toilet flush to dispense the liquid into a toilet bowl. The device includes a reservoir for holding a liquid; a wicking device for transporting the liquid from the reservoir to a dispensing surface; and suspension means for suspending the reservoir and the wicking device from a rim of the toilet bowl. The dispensing device is positioned such that at least a portion of the flow of water during a toilet flush is directed onto the dispensing surface whereby liquid on the dispensing surface is delivered into the toilet bowl during the toilet flush.

In one form of the second aspect of the invention, the dispensing surface is retained in a substantially fixed position when in use in the toilet bowl, and the suspension means is not visible from above the rim of the toilet bowl when the dispensing device is installed on the rim of the toilet bowl. In another form, the dispensing device does not extend inward toward a center point of the toilet bowl beyond a plane defined by an innermost wall of the rim of the toilet bowl when the dispensing device is installed on the rim of the toilet bowl. In yet another form, the dispensing surface is retained in a substantially fixed position when in use in the toilet bowl, and the suspension means does not extend over a top surface of the rim of the toilet bowl when the dispensing device is installed on the rim of the toilet bowl. In still another form, no part of the dispensing device extends over a top surface of the rim of the toilet bowl when the dispensing device is installed on the rim of the toilet bowl.

The suspension means may include an upwardly extending support member and an attached resilient arm wherein the support member and the resilient arm each engage opposed walls under the rim of the toilet bowl when the dispensing device is installed on the rim of the toilet bowl. The opposed walls under the rim of the toilet bowl may be opposed walls of an open rim of an open rim toilet or opposed walls of a flush water passage of a box rim toilet.

It is therefore an advantage of the present invention to provide an improved device that can dispense quantities of cleaning and freshening toilet bowl treatment liquids from under the rim of a toilet bowl during a flush.

It is another advantage of the present invention to provide an under the toilet rim liquid cleansing and/or freshening device that includes a vertical wicking system such that the liquid active substances in the device reservoir are not diluted with flush water.

It is still another advantage of the present invention to provide an under the toilet rim liquid cleansing and/or freshening device that can be installed under the rim of the toilet bowl such that the suspension hook is hidden out of sight and therefore, the liquid dispensing device does not spoil the look of the toilet with an unsightly suspension hook.

It is yet another advantage of the present invention to provide an under the toilet rim liquid cleansing and/or freshening device that can be installed under the rim of the toilet bowl such that the liquid dispensing device is substantially out of sight and therefore, the liquid dispensing device does not spoil the look of the toilet.

It is still another advantage of the present invention to provide an under the toilet rim liquid cleansing and/or freshening device wherein flush water does not enter the opening in the reservoir containing the liquid.

BRIEF DESCRIPTION OF THE DRAWINGS

These and other features, aspects, and advantages of the present invention will become better understood upon consideration of the following detailed description, appended claims, and drawings where:

Like reference numerals will be used to refer to like or similar parts from Figure to Figure in the following description of the invention.

DETAILED DESCRIPTION

Figure 1:
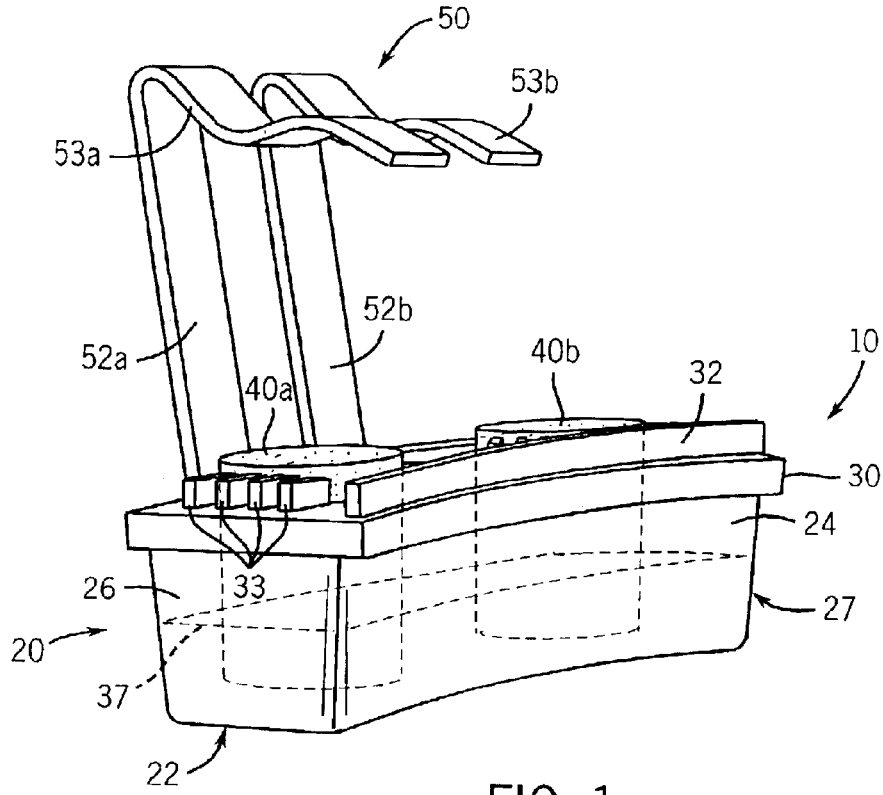
FIG. 1 is a front perspective view of a first embodiment of an under the toilet rim liquid dispensing device in accordance with the invention.
Figure 2:
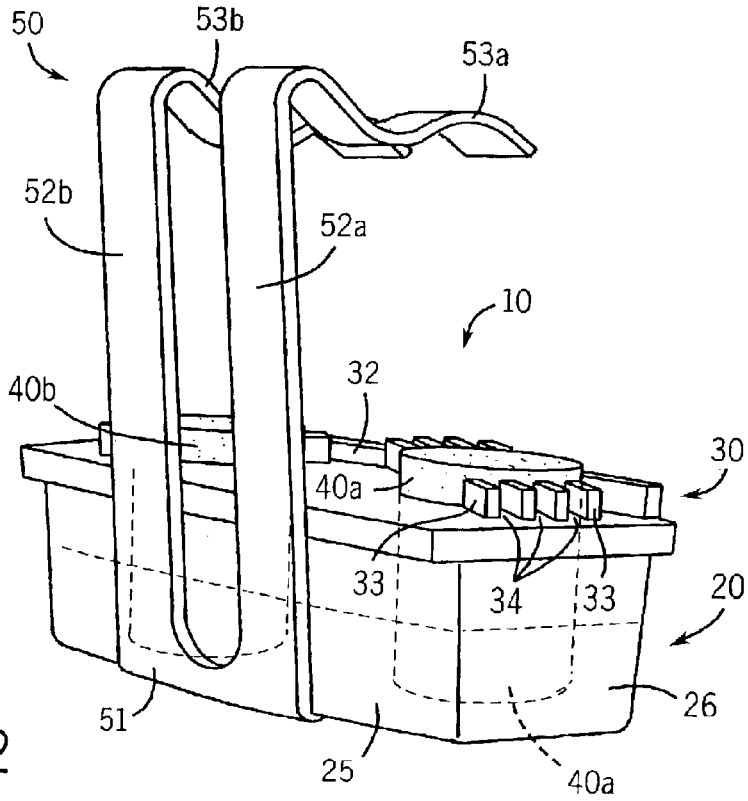
FIG. 2 is a rear, perspective view of the liquid dispensing device of FIG. 1.
Figure 3:
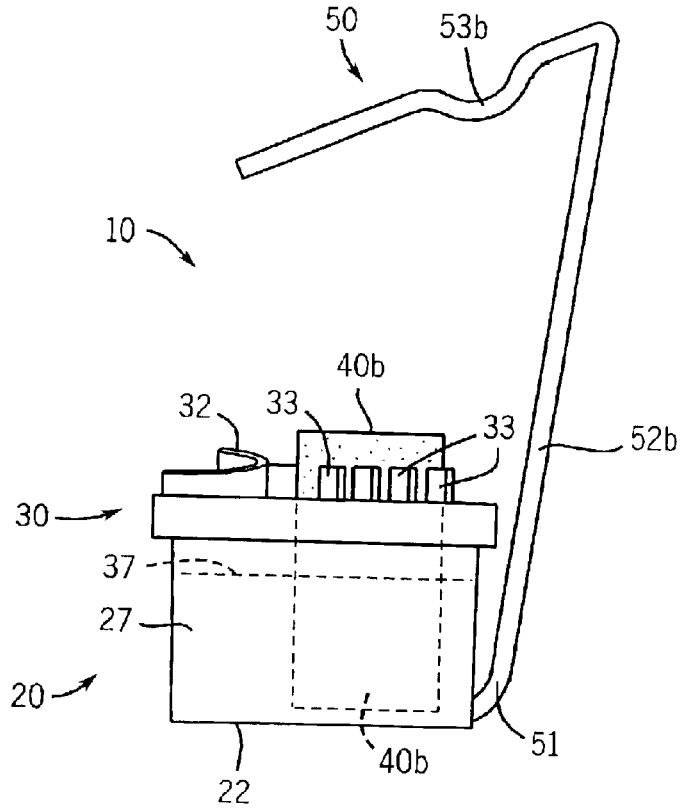
FIG. 3 is a side view of the liquid dispensing device of FIG. 1.
Figure 4:
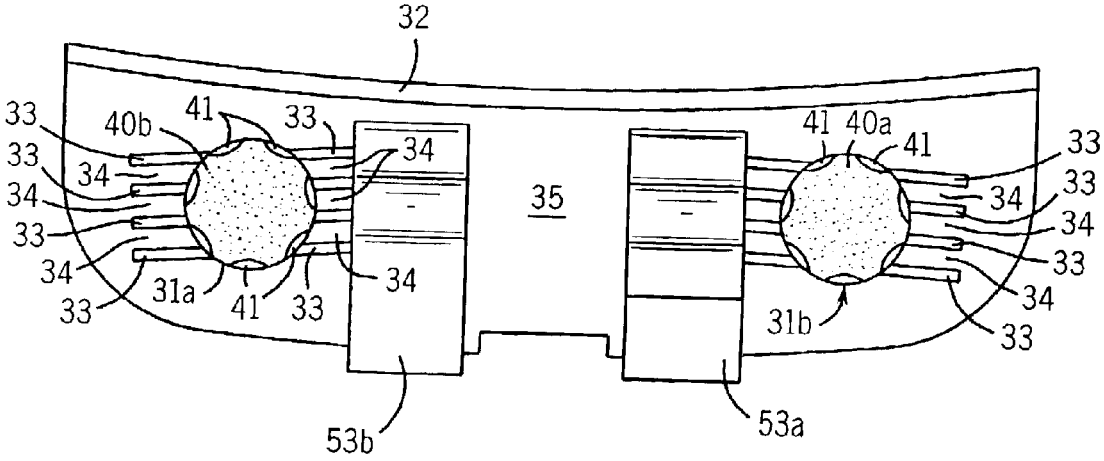
FIG. 4 is a top view of the liquid dispensing device of FIG. 1.
Figure 5:
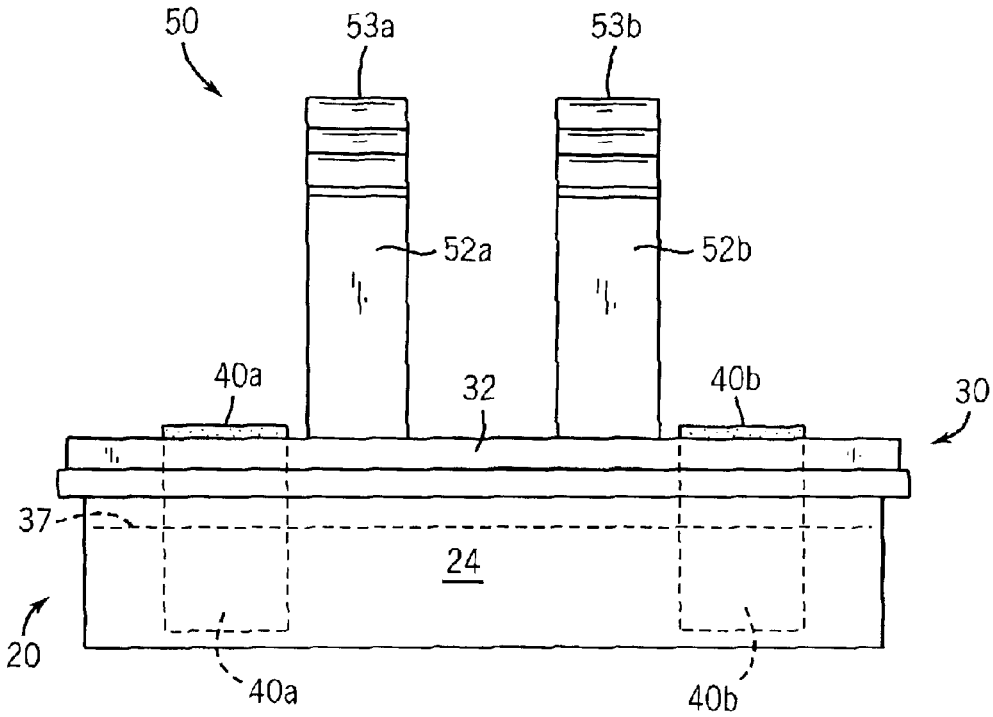
FIG. 5 is a front view of the liquid dispensing device of FIG. 1.
Figure 6:
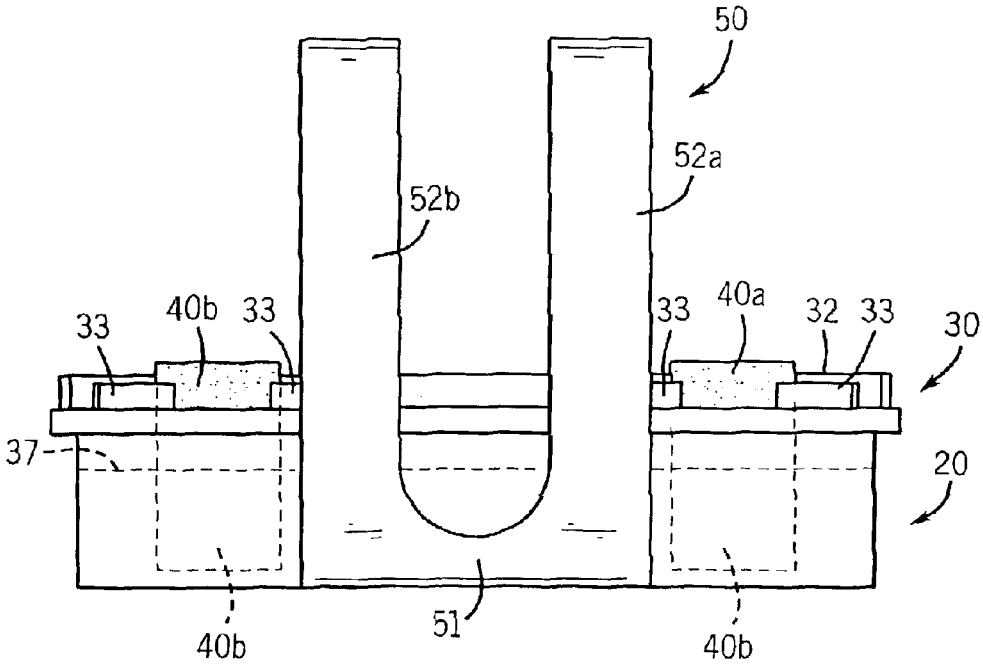
FIG. 6 is a rear view of the liquid dispensing device of FIG. 1.
Figure 7:
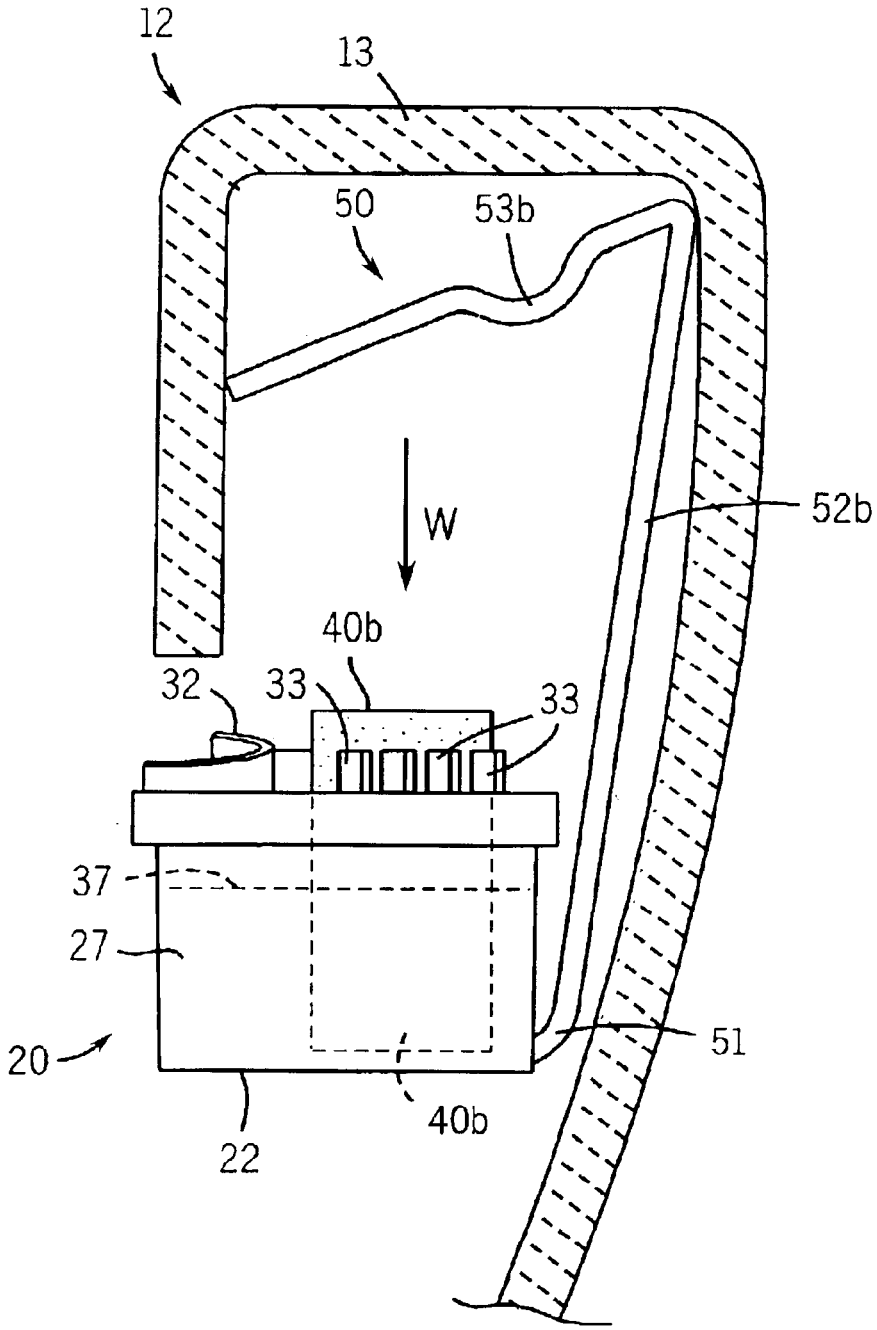
FIG. 7 is a side view of the liquid dispensing device of FIG. 1 installed on a open rim type toilet.
Figure 8:
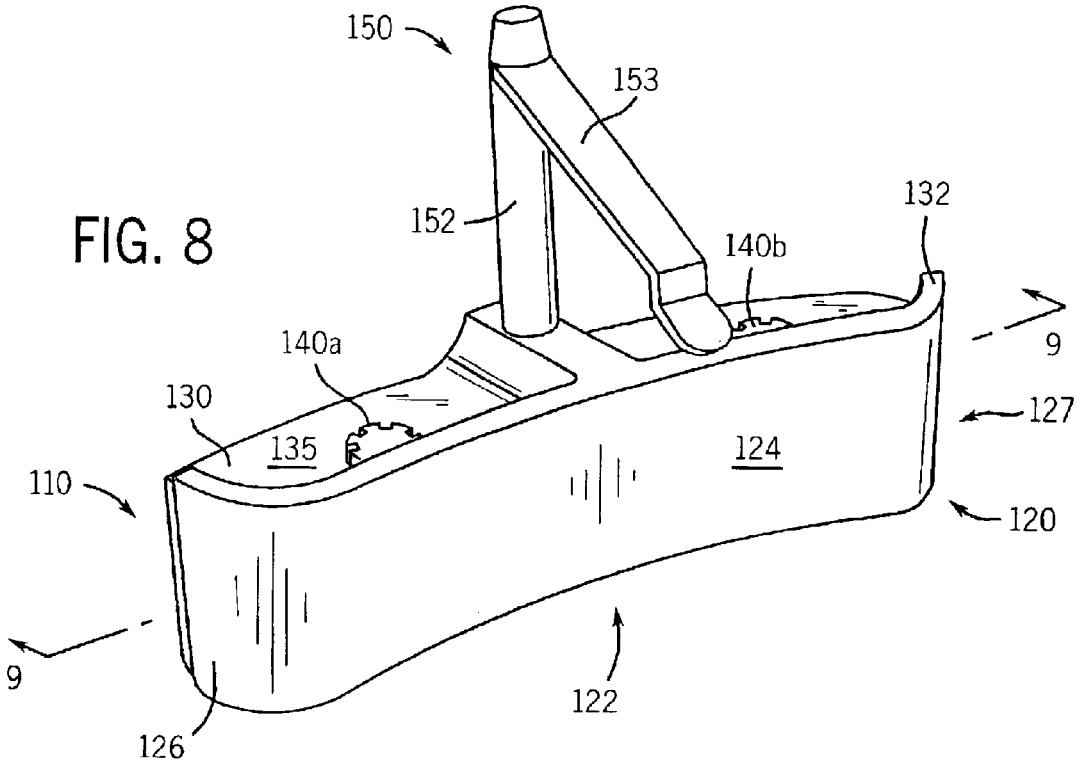
FIG. 8 is a front perspective view of a second embodiment of an under the toilet rim liquid dispensing device in accordance with the invention.

Referring to FIGS. 1–7, there is shown a first embodiment of a liquid dispensing device 10 for dispensing cleaning and/or freshening liquids from the rim of a toilet bowl. The liquid dispensing device 10 includes a reservoir 20 containing a liquid 37, a suspension means 50 for suspending the reservoir 20 from the rim of a toilet bowl (as shown in FIG. 7), and a pair of wicks 40*a* and 40*b*. The liquid 37 used in the reservoir 20 may be any liquid formula having the cleaning, foaming, disinfecting and fragrancing characteristics required for the specific toilet cleaning application. One example liquid 37 comprises an anionic surfactant, nonionic surfactants, a sequesterant, a base to control pH, a preservative, a fragrance, and a dye. Another example liquid 37 includes 72.581 wt. % water, 10 wt. % sodium lauryl ether sulfate, 5 wt. % ethoxylated fatty alcohol, 5 wt. % alkyl polyglucoside, 0.4 wt. % diphosphonic acid sequesterant, 0.303 wt. % sodium hydroxide, 0.016 wt. % preservative, 6.4 wt. % fragrance and 0.3 wt. % dye. The wicks 40*a* and 40*b* convey by capillary action the liquid 37 from the reservoir 20 to a position at or above the upper surface of the reservoir where the flow of water during a toilet flush washes liquid on the upper surface of the reservoir and/or liquid on the wick into the toilet bowl. The wick material, the specific surfactants in the liquid 37 and the amount of surfactants in the liquid 37 can be varied to control the upward capillary action of the liquid 37 on the wicks 40*a* and 40*b*.

The reservoir 20 includes a bottom wall 22, a front wall 24, a rear wall 25, and opposed side walls 26 and 27. The front wall 24, the rear wall 25, and the opposed side walls 26 and 27 extend upwardly from the bottom wall 22. A cover plate 30 to secured to the top edges of the front wall 24, the rear wall 25, and the opposed side walls 26 and 27 thereby forming the reservoir 20. The cover plate 30 of the reservoir 20 includes a pair of spaced apart openings 31*a* and 31*b* that provide access to the liquid 37 in the reservoir 20. The cover plate 30 also includes walls 33 that extend upwardly from the upper surface 35 of the cover plate 30. The walls 33 define feed channels 34 on the upper surface 35 of the cover plate 30. The feed channels 34 extend from a first region on the upper surface 35 in the vicinity of the openings 31*a* and 31*b* to a second region on the upper surface 35 further from the openings 31*a* and 31*b*. The cover plate 30 also includes a rim 32 that extends upwardly from a front region of the perimeter of the upper surface 35 of the cover plate 30. While a variety of materials may be used to form the reservoir 20 and the cover plate 30, it is preferable to manufacture these components from a thermoplastic material such as polyethylene or polypropylene. Typically, the reservoir 20 comprises a transparent thermoplastic material such as clear polyethylene or polypropylene, and the cover plate 30 comprises an opaque thermoplastic material such as pigmented polyethylene or polypropylene. The reservoir 20 and the cover plate 30 may be secured to each other using conventional means such as heat sealing.

The suspension means 50 comprises a base section 51 that is secured to the reservoir 20 and a pair of parallel, spaced apart support members 52*a* and 52*b* connected to the base section 51. The support members 52*a* and 52*b* terminate in resilient arms 53*a* and 53*b* respectively. The resilient arms 53*a* and 53*b* extend laterally and obliquely downwardly from the support members 52*a* and 52*b*. While a variety of materials may be used to form the suspension means 50, it is preferable to manufacture this component from a thermoplastic material such as polyethylene or polypropylene. Typically, the suspension means 50 comprise an opaque thermoplastic material such as pigmented polyethylene or polypropylene. The reservoir 20 and the suspension means 50 may be secured to each other using conventional means such as heat sealing, or may be formed as one piece using conventional plastic molding techniques.

The pair of wicks 40*a* and 40*b* are respectively inserted in the openings 31*a* and 31*b* in the cover plate 30 of the reservoir 20. The wicks 40*a* and 40*b* can be formed from a conventional wick material. Suitable wick materials include: porous or sintered plastics such as ultra high molecular weight polyethylene and polypropylene; bonded fibers such as polyesters and polypropylene; glass-sintered fibers; porous ceramic; carbon fiber; sintered carbon; wood and compressed wood composites; bundled or woven natural fibers such as cotton, wood, linen; and bundled or woven man made fibers such as nylon, polypropylene, polyethylene, polyesters, polyamides, rayon, and polyacetates, or the like.

Preferably, the wicks 40*a* and 40*b* are formed from a hydrophobic material, and most preferably, the wicks 40*a* and 40*b* are formed from porous or sintered polyethylene or polypropylene. The wicks 40*a* and 40*b* can be made by any conventional manufacturing techniques appropriate to such structures (e.g., molding, extrusion, machining). The wicks 40*a* and 40*b* are preferably formed in a generally cylindrical shape and have vertical capillary grooves 41*a* and 41*b*, which are open-faced channels, to provide fluid transport channels that transport the liquid 37 upwardly from the reservoir 20 to a position at or above the upper surface 35 of the cover plate 30 of the reservoir 20. The capillary action provided by adherence of the liquid 37 to the sides of the vertical capillary grooves 41*a* and 41*b* serves to move the liquid 37 upward toward the upper end of the wicks 40*a* and 40*b*. At the upper end of the wicks 40*a* and 40*b*, the liquid 37 may also be distributed onto the upper surface 35 of the cover plate 30 and into the feed channels 34 on the upper surface 35 of the cover plate 30 where capillary action provided by adherence of the liquid 37 to the sides of the walls 33 serves to move the liquid 37 toward the outer regions of the upper surface 35 of the cover plate 30. The wicks 40*a* and 40*b* may also comprise a porous structure such that the pores provide fluid transport channels that transport the liquid 37 upwardly from the reservoir 20 to a position at or above the upper surface 35 of the cover plate 30 of the reservoir 20. While a dispensing device 10 having a reservoir cover plate 30 with two openings 31*a* and 31*b* and having two wicks 40*a* and 40*b* has been described, one opening and wick or any greater number of openings and associated wicks may be used in the dispensing device.

Having described the structure of the liquid dispensing device 10, the operation of the liquid dispensing device 10 can be explained further. The liquid dispensing device 10 is first installed on a toilet bowl rim as in FIG. 7 which illustrates the configuration of the dispensing device 10 when used with a toilet 12 with an open rim. It can be seen from FIG. 7 that the support members 52*a* (hidden) and 52*b* and resilient arms 53*a* (hidden) and 53*b* each engage opposed walls 14*a* and 14*b* under the rim 13 of the toilet bowl 12 when the dispensing device 10 is installed on the rim 13 of the toilet bowl 12. The dispensing device 10 may be installed as shown in FIG. 7 by pressing the suspension means 50 up under the rim 13 of the toilet bowl 12. FIG. 7 also shows that the support members 52*a* and 52*b* of the suspension means 50 are located between the reservoir 20 and the inner wall 14*a* of the toilet bowl 12 when the dispensing device 10 is installed on the rim 13 of the toilet bowl 12. With the dispensing device 10 suspended from the rim 13 of such a toilet 12, it can be seen that the stream of flushing water, indicated by the arrow W, will contact the upper surface 35 of the cover plate 30 and the wicks 40*a* and 40*b*.

After installing the liquid dispensing device 10 on the rim 13 of the toilet bowl 12 as shown in FIG. 7, the liquid dispensing device 10 is ready for operation. The capillary action provided by adherence of the liquid 37 to the sides of the vertical capillary grooves 41*a* and 41*b* of the wicks 40*a* and 40*b* serves to move the liquid 37 upward toward the upper end of the wicks 40*a* and 40*b*. At the upper end of the wicks 40*a* and 40*b*, the liquid 37 may also be distributed onto the upper surface 35 of the cover plate 30 and into the feed channels 34 on the upper surface 35 of the cover plate 30 where capillary action provided by adherence of the liquid 37 to the sides of the walls 33 serves to move the liquid 37 toward the outer regions of the upper surface 35 of the cover plate 30. When the toilet is flushed, at least a portion of the flow of flush water contacts the wicks 40*a* and 40*b* and the upper surface 35 of the reservoir 20 whereby liquid 37 on the upper surface 35 of the reservoir 20 and/or liquid 37 on the wicks 40*a* and 40*b* is mixed with flush water and delivered into the toilet bowl 12 during the toilet flush. After the flushing water washes liquid 37 from the upper surface 35 of the reservoir 20 and/or the wicks 40*a* and 40*b* into the toilet water, a fresh supply of liquid 37 is distributed from the reservoir 20 to the upper end of the wicks 40*a* and 40*b* and onto the upper surface 35 of the cover plate 30 as described above. The fresh supply of liquid 37 is then available for the next toilet flush.

Figure 9:
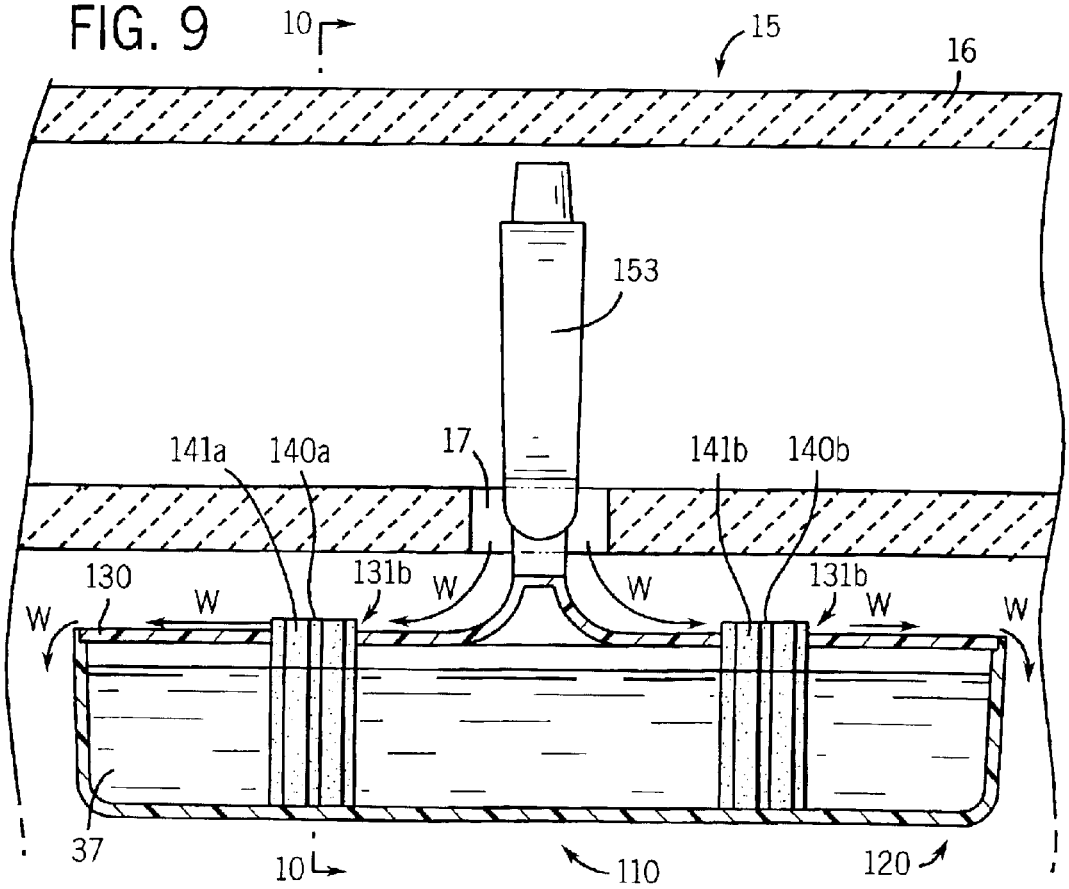
FIG. 9 is a cross sectional view taken along line 9—9 of FIG. 8 showing the liquid dispensing device of FIG. 8 installed on a box rim type toilet.
Figure 10:
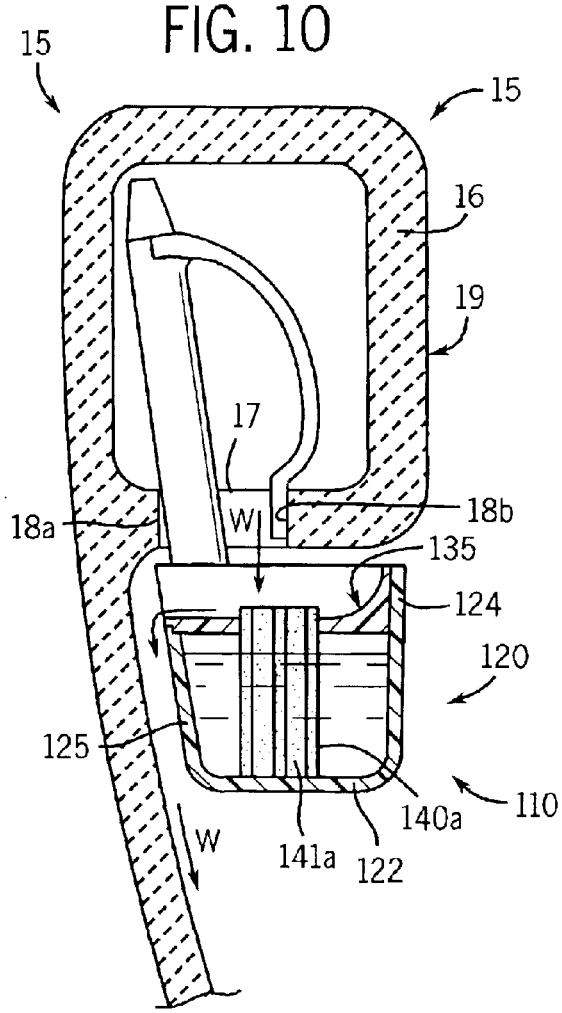
FIG. 10 is a cross sectional view taken along line 10—10 of FIG. 9 showing the liquid dispensing device of FIG. 8 installed on a box rim type toilet.
Figure 11:
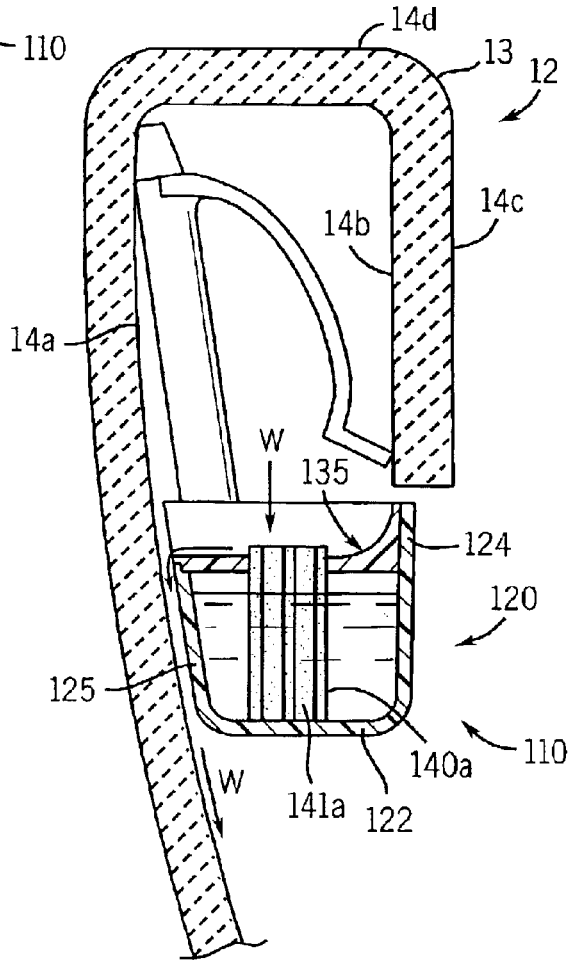
FIG. 11 is a side view of the liquid dispensing device of FIG. 8 installed on an open rim type toilet.

Referring to FIGS. 8–11, there is shown a second embodiment of a liquid dispensing device 110 for dispensing cleaning and/or freshening liquids from the rim of a toilet bowl. The liquid dispensing device 110 includes an arcuate shaped reservoir 120 containing a liquid 37, a suspension means 150 for suspending the reservoir 120 from the rim of a toilet bowl (as shown in FIGS. 9–11), and a pair of wicks 140*a* and 140*b*. The liquid 37 used in the reservoir 120 may be any liquid formula as described above with reference to the first embodiment of the liquid dispensing device 10. The wicks 140*a* and 140*b* convey by capillary action the liquid 37 from the reservoir 120 to a position at or above the upper surface of the reservoir where the flow of water during a toilet flush washes liquid on the upper surface of the reservoir and/or liquid on the wick into the toilet bowl.

The reservoir 120 includes a bottom wall 122, a front wall 124, a rear wall 125, and opposed side walls 126 and 127. The front wall 124, the rear wall 125, and the opposed side walls 126 and 127 extend upwardly from the bottom wall 122. A top wall 130 is integral with the top edges of the front wall 124, the rear wall 125, and the opposed side walls 126 and 127 thereby forming the reservoir 120. The top wall 130 of the reservoir 120 includes a pair of spaced apart openings 131*a* and 131*b* that provide access to the liquid 37 in the reservoir 120. The top wall 130 includes a rim 132 that extends upwardly from a front region of the perimeter of the upper surface 135 of the top wall 130. While a variety of materials may be used to form the reservoir 120, it is preferable to manufacture this component from a thermoplastic material such as polyethylene or polypropylene. Typically, the reservoir 120 comprises a transparent thermoplastic material such as clear polyethylene or polypropylene.

The suspension means 150 comprises a support member 152 connected to the upper surface 135 of the top wall 130 of the reservoir 120. The support member 152 terminates in a resilient arm 153. The resilient arm 153 extends laterally and obliquely downwardly from the support member 152. While a variety of materials may be used to form the suspension means 150, it is preferable to manufacture this component from a thermoplastic material such as polyethylene or polypropylene. Typically, the suspension means 150 comprise an opaque thermoplastic material such as pigmented polyethylene or polypropylene. The reservoir 120 and the suspension means 150 may be secured to each other using conventional means such as heat sealing, or may be formed as one piece using conventional plastic molding techniques.

The pair of wicks 140*a* and 140*b* are respectively inserted in the openings 131*a* and 131*b* in the top wall 130 of the reservoir 120. The wicks 140*a* and 140*b* can be formed from a conventional wick material as described above with reference to the first embodiment of the liquid dispensing device 10, and function in the same manner as described above with reference to the first embodiment of the liquid dispensing device 10. While a dispensing device 110 having a reservoir top wall 130 with two openings 131*a* and 131*b* and having two wicks 140*a* and 140*b* has been described, one opening and wick or any greater number of openings and associated wicks may be used in the dispensing device.

Having described the structure of the liquid dispensing device 110, the operation of the liquid dispensing device 110 can be explained further. The liquid dispensing device 110 may be installed on a toilet bowl rim as in FIGS. 9 and 10 which illustrates the configuration of the dispensing device 110 when used with a toilet 15 with a box rim. It can be seen from FIGS. 9 and 10 that the support member 152 and resilient arm 153 engage opposed walls 18*a* and 18*b* of the water passage 17 under the rim 16 of the toilet bowl 15 when the dispensing device 110 is installed on the rim 16 of the toilet bowl 15. The dispensing device 110 may be installed as shown in FIGS. 9 and 10 by inserting the suspension means 150 up into the water passage 17 under the rim 16 of the toilet bowl 15. FIG. 10 shows that when the dispensing device 110 is installed on the rim 16 of the toilet bowl 15, the dispensing device 110 does not extend inward toward a center point of the toilet bowl 15 beyond a plane defined by an innermost wall 19 of the rim 16 of the toilet bowl 15. Also, when the dispensing device 110 is installed on the rim 16 of the toilet bowl 15, the suspension means 150 is not visible from above the rim 16 of the toilet bowl 15. The dispensing surfaces (the wicks 140*a* and 140*b* and/or the upper surface 135 of the reservoir 120) of the liquid dispensing device 110 are retained in a substantially fixed position when in use in the toilet bowl. By "substantially fixed", we mean that the dispensing surface is intended to remain fixed during operation and is only subject to slight movement due to the flush water. Also, no part of the dispensing device 110 extends over a top surface of the rim of the toilet bowl when the dispensing device 110 is installed on the rim of the toilet bowl. With the dispensing device 110 suspended from the rim 16 of such a toilet 15, it can be seen that the stream of flushing water, indicated by the arrow W, will contact the upper surface 135 of the top wall 130 and the wicks 140*a* and 140*b*.

After installing the liquid dispensing device 110 on the rim 16 of the toilet bowl 15 as shown in FIGS. 9 and 10, the liquid dispensing device 110 is ready for operation. The capillary action provided by adherence of the liquid 37 to the sides of the vertical capillary grooves 141*a* and 141*b* of the wicks 140*a* and 140*b* serves to move the liquid 37 upward toward the upper end of the wicks 140*a* and 140*b*. At the upper end of the wicks 140*a* and 140*b*, the liquid 37 may also be distributed onto the upper surface 135 of the top wall 130. When the toilet is flushed, at least a portion of the flow of flush water contacts the wicks 140*a* and 140*b* and the upper surface 135 of the reservoir 120 whereby liquid 37 on the upper surface 135 of the reservoir 120 and/or liquid 37 on the wicks 140*a* and 140*b* is mixed with flush water and delivered into the toilet bowl 15 during the toilet flush. The path of the flush water is shown by the arrows in FIGS. 9 and 10. After the flushing water washes liquid 37 from the upper surface 135 of the reservoir 120 and/or the wicks 140*a* and 140*b* into the toilet water, a fresh supply of liquid 37 is distributed from the reservoir 120 to the upper end of the wicks 140*a* and 140*b* and onto the upper surface 135 of the top wall 130 as described above. The fresh supply of liquid 37 is then available for the next toilet flush.

The liquid dispensing device 110 may also be installed on a toilet bowl rim as in FIG. 11 which illustrates the configuration of the dispensing device 110 when used with a toilet 12 with an open rim. It can be seen from FIG. 11 that the support member 152 and resilient arm 153 engage opposed walls 14*a* and 14*b* under the rim 13 of the toilet bowl 12 when the dispensing device 110 is installed on the rim 13 of the toilet bowl 12. The dispensing device 110 may be installed as shown in FIG. 11 by inserting the suspension means 150 up under the rim 13 of the toilet bowl 12. FIG. 11 shows that when the dispensing device 110 is installed on the rim 13 of the toilet bowl 12, the dispensing device 110 does not extend inward toward a center point of the toilet bowl 12 beyond a plane defined by an innermost wall 14*c* of the rim 13 of the toilet bowl 12. Also, when the dispensing device 110 is installed on the rim 13 of the toilet bowl 12, the suspension means 150 is not visible from above the rim 13 of the toilet bowl 12. Further, when the dispensing device 110 is installed on the rim 13 of the toilet bowl 12, the suspension means 150 does not extend over a top surface 14*d* of the rim 13 of the toilet bowl 12. In addition, when the dispensing device 110 is installed on the rim 13 of the toilet bowl 12, the suspension means 150 does not cover any portion of the innermost wall 14*c* of the rim 13 of the toilet bowl 12. With the dispensing device 110 suspended from the rim 13 of such a toilet 12, it can be seen that the stream of flushing water, indicated by the arrow W, will contact the upper surface 135 of the top wall 130 and the wicks 140*a* and 140*b*.

After installing the liquid dispensing device 110 on the rim 13 of the toilet bowl 12 as shown in FIG. 11, the liquid dispensing device 110 is ready for operation. The capillary action provided by adherence of the liquid 37 to the sides of the vertical capillary grooves 141*a* and 141*b* of the wicks 140*a* and 140*b* serves to move the liquid 37 upward toward the upper end of the wicks 140*a* and 140*b*. At the upper end of the wicks 140*a* and 140*b*, the liquid 37 may also be distributed onto the upper surface 135 of the top wall 130. When the toilet is flushed, at least a portion of the flow of flush water contacts the wicks 140*a* and 140*b* and the upper surface 135 of the reservoir 120 whereby liquid 37 on the upper surface 135 of the reservoir 120 and/or liquid 37 on the wicks 140*a* and 140*b* is mixed with flush water and delivered into the toilet bowl 15 during the toilet flush. After the flushing water washes liquid 37 from the upper surface 135 of the reservoir 120 and/or the wicks 140*a* and 140*b* into the toilet water, a fresh supply of liquid 37 is distributed from the reservoir 120 to the upper end of the wicks 140*a* and 140*b* and onto the upper surface 135 of the top wall 130 as described above. The fresh supply of liquid 37 is then available for the next toilet flush.

The liquid dispensing device 10 and the liquid dispensing device 110 have many advantages. For example, by using a wick comprising a hydrophobic material, the liquid 37 is delivered to the toilet bowl without flush water entering the reservoir and diluting the product. Also, the liquid dispensing device 10 and the liquid dispensing device 110 can be installed under the rim of the toilet bowl such that the liquid dispensing device 10 and the liquid dispensing device 110 are out of sight and therefore, the liquid dispensing device 10 and the liquid dispensing device 110 do not spoil the look of the toilet.

Alternative forms of the liquid dispensing device 10 and the liquid dispensing device 110 are also possible. For example, the wicks 40*a* and 40*b* of the liquid dispensing device 10 and the wicks 140*a* and 140*b* of the liquid dispensing device 110 can be replaced with other wicking devices such as a dispensing plate or porous mass. By "wicking device", we mean an element that can transfer a fluid by capillary action from one location to another location. These alternative wicking devices transport liquid from the reservoir 20 or 120 to a dispensing surface such as a surface of the dispensing plate or porous mass.

EXAMPLE

This example serves to further illustrate the invention. The example is not intended to limit the invention in any way. A circular opening was created in the upper surface of a generally parallelepiped reservoir suitable for mounting under the rim of a toilet bowl. The reservoir was then filled with a solution including 75.380 wt. % deionized water, 6 wt. % alkyl ethoxy sulfate, 6 wt. % perfume, 6 wt. % dipropylene glycol, 6 wt. % ethoxylated fatty alcohol, 0.02 wt. % Acid Blue #9 dye, 0.4 wt. % diphosphonic acid sequesterant, and 0.2 wt. % sodium hydroxide. A cylindrical, sintered, ultra high molecular weight polyethylene wick (which is also suitable for use in air fresheners) was then inserted in the opening in the reservoir.

A first reading of the solution in the reservoir was then taken using a spectrophotometer operating at 620 nanometers, and the level of solution in the reservoir was also recorded. The reservoir was then suspended from the rim of a toilet bowl that is part a computerized automatic toilet flushing system wherein a number of standard construction toilets are automatically flushed according to a schedule. The reservoir was positioned within the flow of water during a toilet flush such that at least a portion of the flow of water was directed onto the wick and the upper surface of the reservoir during the toilet flush. After 3 weeks of flushes, a second reading of the solution in the reservoir was taken using a spectrophotometer operating at 620 nanometers, and the level of solution in the reservoir was recorded. After 3 weeks, the level of solution in the reservoir had dropped indicating that the solution was distributed into the toilet bowl. Also, the first reading and the second reading of the solution were the same indicating that flush water had not entered the reservoir and diluted the solution.

Thus, there has been provided a device for dispensing liquids, such as cleaning and freshening liquids, from under the rim of a toilet bowl by way of the flow of water during a toilet flush. The under the toilet rim liquid cleansing and/or freshening device distributes the liquid to a position at or near an upper surface of a liquid reservoir by way of a vertical wicking system. The wick is formed from a hydrophobic material in order to repel flush water so that flush water does not travel down the side of the wick and thereby dilute the liquids with flush water. The under the toilet rim liquid cleansing and/or freshening device can be installed under the rim of the toilet bowl such that the liquid dispensing device is substantially out of sight and therefore, the liquid dispensing device does not spoil the look of the toilet.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention may be used for dispensing liquids, such as cleaning and freshening liquids, from under the rim of a toilet bowl by way of the flow of water during a toilet flush.

What is claimed is:

1. A dispensing device for using a flow of water during a toilet flush to dispense a liquid into a toilet bowl, the device comprising:

a reservoir for holding a liquid, the reservoir having an upper surface with an opening;

a wick disposed in the opening such that the wick contacts the liquid in the reservoir and extends to a position at or above the upper surface of the reservoir, the wick being suitable for transporting the liquid upward from the reservoir to the position at or above the upper surface of the reservoir; and suspension means for suspending the reservoir from a rim of the toilet bowl, wherein the dispensing device is positioned within the flow of water during a toilet flush such that at least a portion of the flow of water is directed onto the wick and the upper surface of the reservoir whereby liquid on the upper surface of the reservoir and/or liquid on the wick is delivered into the toilet bowl during the toilet flush.

2. The dispensing device of claim 1, wherein the reservoir comprises:

a container having a bottom wall and a side wall extending upwardly from the bottom wall, and a cover plate secured to the side wall, the cover plate forming the upper surface and the opening of the reservoir.

3. The dispensing device of claim 1, wherein:

the upper surface of the reservoir has a plurality of openings, and a wick is disposed in each opening such that each wick contacts the liquid in the reservoir and extends to a position at or above the upper surface of the reservoir, each wick being suitable for transporting the liquid from the reservoir to the position at or above the upper surface of the reservoir.

4. The dispensing device of claim 1, wherein the reservoir includes a rim extending upwardly from at least a portion of a perimeter of the upper surface of the reservoir.

5. The dispensing device of claim 1, wherein the upper surface of the reservoir includes at least one feed channel extending from a first region on the upper surface in the vicinity of the opening to a second region on the upper surface further from the opening.

6. The dispensing device of claim 1, wherein the wick includes fluid transport channels.

7. The dispensing device of claim 6, wherein the fluid transport channels comprise vertical grooves in an outer surface of the wick.

8. The dispensing device of claim 1, wherein the wick comprises a hydrophobic material.

9. The dispensing device of claim 1, wherein the wick comprises a sintered plastic.

10. The dispensing device of claim 1, wherein the wick comprises sintered polyethylene.

11. The dispensing device of claim 1, wherein the wick comprises a porous plastic.

12. The dispensing device of claim 1, wherein the wick comprises porous polyethylene.

13. The dispensing device of claim 1, wherein the opening and a horizontal cross-section of the wick are circular.

14. The dispensing device of claim 1, wherein the suspension means comprises an upwardly extending support member and an attached resilient arm, the support member and the resilient arm each engaging opposed walls under the rim of the toilet bowl when the dispensing device is installed on the rim of the toilet bowl.

15. The dispensing device of claim 14, wherein the support member of the suspension means is located between the reservoir and an inner wall of the toilet bowl when the dispensing device is installed on the rim of the toilet bowl.

16. The dispensing device of claim 14, wherein the opposed walls under the rim of the toilet bowl comprise opposed walls of an open rim of an open rim toilet.

17. The dispensing device of claim 14, wherein the opposed walls under the rim of the toilet bowl comprise opposed walls of a flush water passage of a box rim toilet.

18. The dispensing device of claim 1, wherein the dispensing device does not extend inward toward a center point of the toilet bowl beyond a plane defined by an innermost wall of the rim of the toilet bowl when the dispensing device is installed on the rim of the toilet bowl.

19. The dispensing device of claim 1, wherein the suspension means is not visible from above the rim of the toilet bowl when the dispensing device is installed on the rim of the toilet bowl.

20. The dispensing device of claim 1, wherein a horizontal cross-section of the reservoir has an arcuate shape.

21. The dispensing device of claim 1, wherein the liquid includes at least one surfactant to facilitate upward transport of the liquid on the wick from the reservoir to the position at or above the upper surface of the reservoir.

22. The dispensing device of claim 1, wherein the flow of water during a toilet flush does not enter the opening.

23. The dispensing device of claim 1, wherein the suspension means does not extend over a top surface of the rim of the toilet bowl when the dispensing device is installed on the rim of the toilet bowl.

24. The dispensing device of claim 1, wherein the suspension means does not cover any portion of an innermost wall of the rim of the toilet bowl when the dispensing device is installed on the rim of the toilet bowl.

25. A dispensing device for using a flow of water during a toilet flush to dispense a liquid into a toilet bowl, the device comprising:

a reservoir for holding a liquid;

a wicking device for transporting the liquid from the reservoir to a dispensing surface; and suspension means for suspending the reservoir and the wicking device from a rim of the toilet bowl, wherein the dispensing device is positioned such that at least a portion of the flow of water during a toilet flush is directed onto the dispensing surface whereby liquid on the dispensing surface is delivered into the toilet bowl during the toilet flush, wherein the dispensing surface is retained in a substantially fixed position when in use in the toilet bowl, and wherein the suspension means is not visible from above the rim of the toilet bowl when the dispensing device is installed on the rim of the toilet bowl.

26. The dispensing device of claim 25, wherein the suspension means comprises an upwardly extending support member and an attached resilient arm, the support member and the resilient arm each engaging opposed walls under the rim of the toilet bowl when the dispensing device is installed on the rim of the toilet bowl.

27. The dispensing device of claim 26, wherein the opposed walls under the rim of the toilet bowl comprise opposed walls of an open rim of an open rim toilet.

28. The dispensing device of claim 26, wherein the opposed walls under the rim of the toilet bowl comprise opposed walls of a flush water passage of a box rim toilet.

29. A dispensing device for using a flow of water during a toilet flush to dispense a liquid into a toilet bowl, the device comprising:

a reservoir for holding a liquid;

a wicking device for transporting the liquid from the reservoir to a dispensing surface; and suspension means for suspending the reservoir and the wicking device from a rim of the toilet bowl, wherein the dispensing device is positioned such that at least a portion of the flow of water during a toilet flush is directed onto the dispensing surface whereby liquid on the dispensing surface is delivered into the toilet bowl during the toilet flush, and wherein the dispensing device does not extend inward toward a center point of the toilet bowl beyond a plane defined by an innermost wall of the rim of the toilet bowl when the dispensing device is installed on the rim of the toilet bowl.

30. The dispensing device of claim 29, wherein the suspension means comprises an upwardly extending support member and an attached resilient arm, the support member and the resilient arm each engaging opposed walls under the rim of the toilet bowl when the dispensing device is installed on the rim of the toilet bowl.

31. The dispensing device of claim 30, wherein the opposed walls under the rim of the toilet bowl comprise opposed walls of an open rim of an open rim toilet.

32. The dispensing device of claim 30, wherein the opposed walls under the rim of the toilet bowl comprise opposed walls of a flush water passage of a box rim toilet.

33. A dispensing device for using a flow of water during a toilet flush to dispense a liquid into a toilet bowl, the device comprising:

a reservoir for holding a liquid;

a wicking device for transporting the liquid from the reservoir to a dispensing surface; and suspension means for suspending the reservoir and the wicking device from a rim of the toilet bowl, wherein the dispensing device is positioned such that at least a portion of the flow of water during a toilet flush is directed onto the dispensing surface whereby liquid on the dispensing surface is delivered into the toilet bowl during the toilet flush, wherein the dispensing surface is retained in a substantially fixed position when in use in the toilet bowl, and wherein the suspension means does not extend over a top surface of the rim of the toilet bowl when the dispensing device is installed on the rim of the toilet bowl.

34. The dispensing device of claim 33, wherein the suspension means comprises an upwardly extending support member and an attached resilient arm, the support member and the resilient arm each engaging opposed walls under the rim of the toilet bowl when the dispensing device is installed on the rim of the toilet bowl.

35. The dispensing device of claim 34, wherein the opposed walls under the rim of the toilet bowl comprise opposed walls of an open rim of an open rim toilet.

36. The dispensing device of claim 34, wherein the opposed walls under the rim of the toilet bowl comprise opposed walls of a flush water passage of a box rim toilet.

37. The dispensing device of claim 34, wherein the opposed walls under the rim of the toilet bowl comprise opposed walls of a flush water passage of a box rim toilet.

38. A dispensing device for using a flow of water during a toilet flush to dispense a liquid into a toilet bowl, the device comprising:

a reservoir for holding a liquid;

a wicking device for transporting the liquid from the reservoir to a dispensing surface; and suspension means for suspending the reservoir and the wicking device from a rim of the toilet bowl, wherein the dispensing device is positioned such that at least a portion of the flow of water during a toilet flush is directed onto the dispensing surface whereby liquid on the dispensing surface is delivered into the toilet bowl during the toilet flush, and wherein no part of the dispensing device extends over a top surface of the rim of the toilet bowl when the dispensing device is installed on the rim of the toilet bowl.

39. The dispensing device of claim 38, wherein the suspension means comprises an upwardly extending support member and an attached resilient arm, the support member and the resilient arm each engaging opposed walls under the rim of the toilet bowl when the dispensing device is installed on the rim of the toilet bowl.

40. The dispensing device of claim 39, wherein the opposed walls under the rim of the toilet bowl comprise opposed walls of an open rim of an open rim toilet.

* * * * *